US007731107B2

(12) United States Patent
Grether

(10) Patent No.: US 7,731,107 B2
(45) **Date of Patent: *Jun. 8, 2010**

(54) COMPONENT INCORPORATED IN A PLUMBING SYSTEM

(75) Inventor: Hermann Grether, Müllheim (DE)

(73) Assignee: Neoperl GmbH, Mullheim (DE)

( * ) Notice: Subject to any disclaimer, the term of this patent is extended or adjusted under 35 U.S.C. 154(b) by 984 days.

This patent is subject to a terminal disclaimer.

(21) Appl. No.: 10/519,572

(22) PCT Filed: Sep. 26, 2003

(86) PCT No.: PCT/EP03/10727

§ 371 (c)(1),
(2), (4) Date: Dec. 28, 2004

(87) PCT Pub. No.: WO2004/033108

PCT Pub. Date: Apr. 22, 2004

(65) Prior Publication Data

US 2005/0247805 A1 Nov. 10, 2005

(30) Foreign Application Priority Data

Oct. 4, 2002 (DE) ..... 102 46 334

(51) Int. Cl.

| | |
|---|---|
| ***E03C 1/08*** | (2006.01) |
| ***B05B 1/26*** | (2006.01) |
| ***B05B 1/14*** | (2006.01) |
| ***B05B 1/00*** | (2006.01) |
| *E03C 1/084* | (2006.01) |

(52) U.S. Cl. ..... 239/500; 239/391; 239/396; 239/428.5; 239/462; 239/518; 239/553.3; 239/590; 239/590.3; 239/600

(58) Field of Classification Search ..... 239/390, 239/391, 396, 427, 428.5, 462, 500, 504, 239/518, 520, 553, 553.3, 553.5, 590, 590.3, 239/590.5, 600

See application file for complete search history.

(56) References Cited

U.S. PATENT DOCUMENTS

| | | | | |
|---|---|---|---|---|
| 4,637,552 | A * | 1/1987 | Finkbeiner et al. | 239/428.5 |
| 5,184,641 | A * | 2/1993 | Kuhn | 137/504 |
| 5,769,326 | A * | 6/1998 | Muchenberger et al. | 239/428.5 |

(Continued)

FOREIGN PATENT DOCUMENTS

| | | |
|---|---|---|
| DE | 196 47 798 | 5/1998 |

(Continued)

*Primary Examiner*—Darren W Gorman
(74) *Attorney, Agent, or Firm*—Volpe and Koenig, P.C.

(57) ABSTRACT

The invention concerns a sanitary component (1) that has a jet regulating device (4) in the interior of a mounting housing (6). The jet regulating device (4) includes at least one directly-mounted element (5) housed in the mounting housing (6), this element being provided with ridges (11) transverse to the flow direction and defining between them passageways (12). The invention is characterized in that the ridges (11) of at least one directly mounted element (5) are arranged in the form of a grid or network and intersect at junction points. The component (1) according to the invention, which can be manufactured inexpensively, exhibits the best possible jet regulating characteristics, even if the transverse surface is relatively small; moreover, the component (1) according to the invention requires little maintenance, without any risk of malfunction resulting from dirt carried by the liquid flow.

31 Claims, 15 Drawing Sheets

U.S. PATENT DOCUMENTS

| | | | | |
|---|---|---|---|---|
| 5,803,368 | A * | 9/1998 | Shekalim | 239/428.5 |
| 6,126,093 | A | 10/2000 | Grether et al. | |
| 6,152,182 | A | 11/2000 | Grether et al. | |
| 6,588,682 | B1 | 7/2003 | Flieger | |
| 2004/0050968 | A1 | 3/2004 | Grether et al. | |

FOREIGN PATENT DOCUMENTS

| | | |
|---|---|---|
| DE | 200 06 163 | 8/2000 |
| DE | 200 10 101 | 10/2000 |
| DE | 101 49 335 | 4/2003 |
| WO | WO 01/96673 | 5/2001 |

* cited by examiner

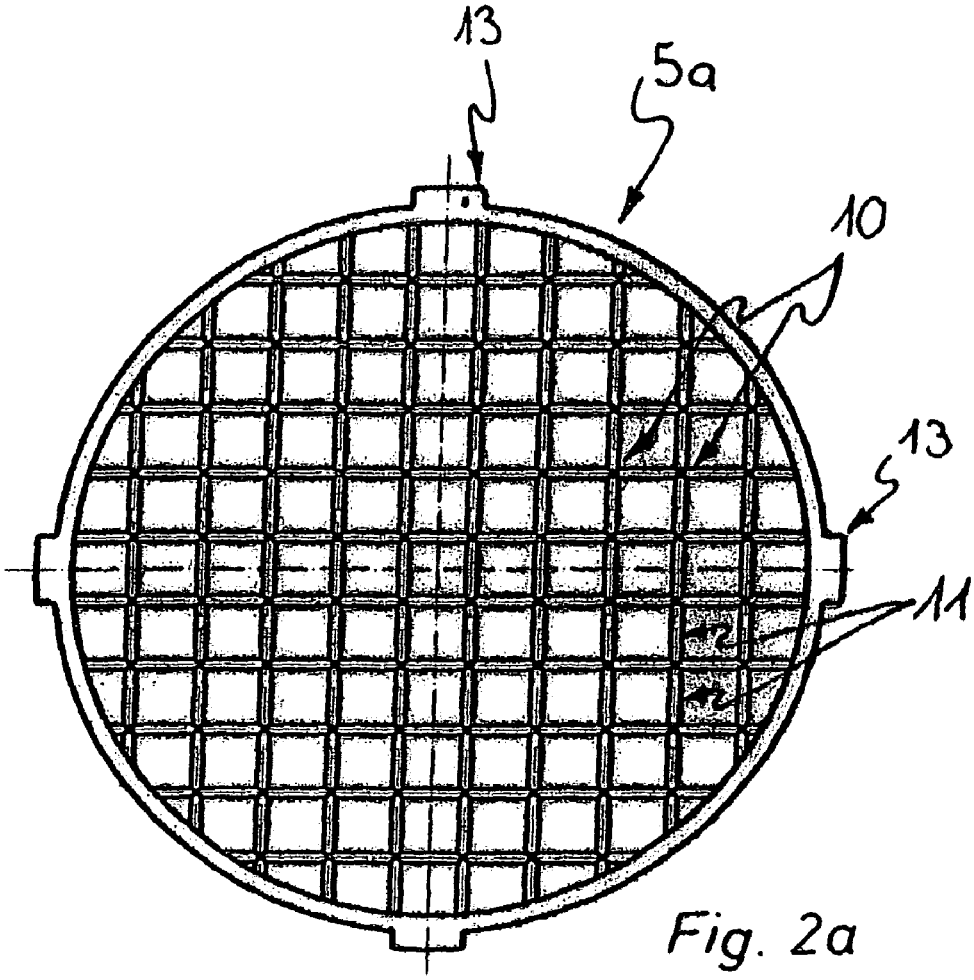
Fig. 2a
Fig. 2b
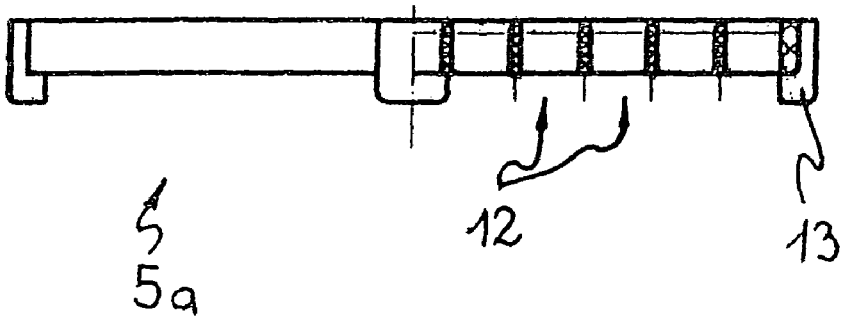

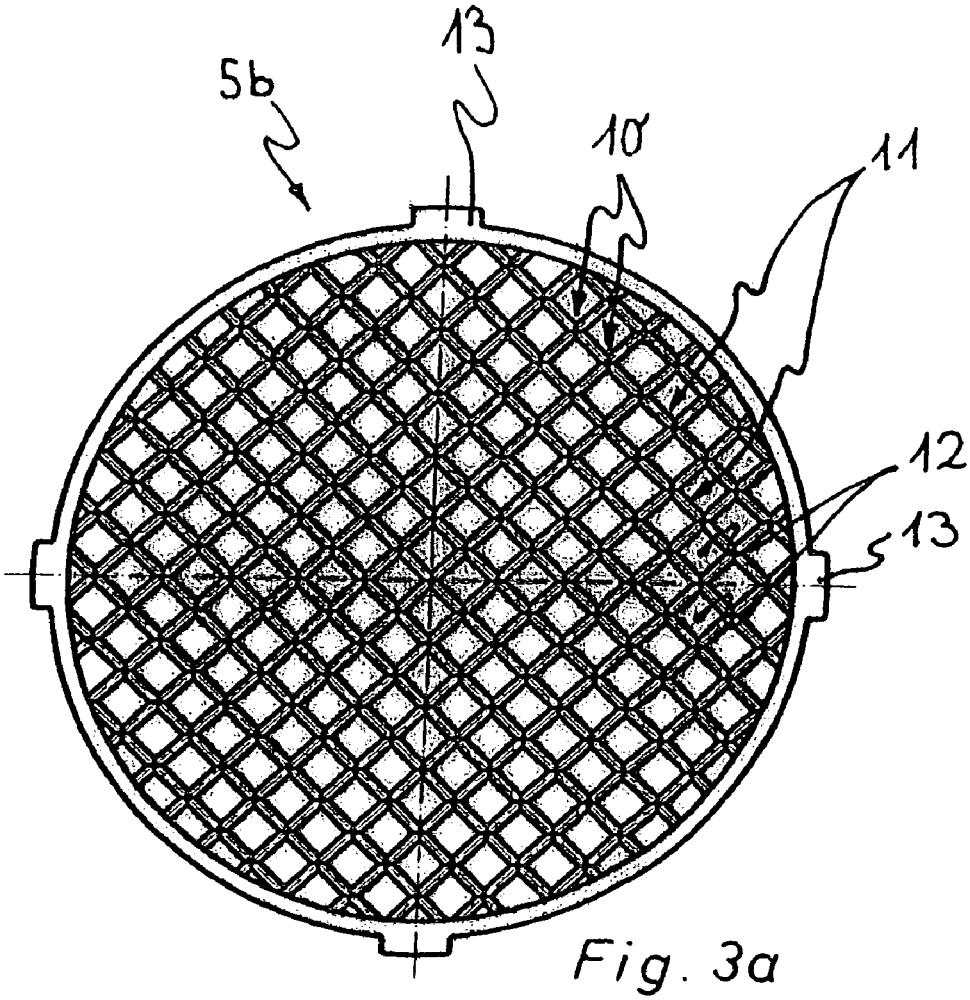
Fig. 3a
Fig. 3b
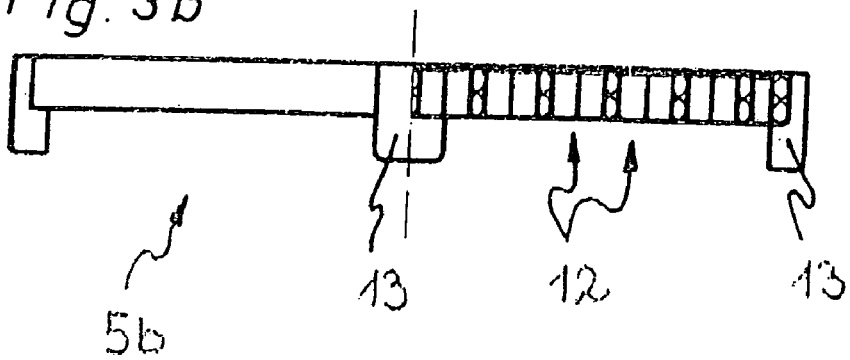

COMPONENT INCORPORATED IN A PLUMBING SYSTEM

BACKGROUND

The invention concerns a sanitary component that has a jet regulating device in the interior of a mounting housing; said jet regulating device comprises at least one directly-mounted element housed in the mounting housing; said element has bars transverse to the flow direction that define passageways between them. A jet regulator with a jet-regulator housing is already known from the DE 100 27 987 A1, in whose housing interior a jet regulating device is provided which has additional mounting elements that are directly mounted in the jet regulator housing one after the other in the direction of flow. Each of these mounted elements possesses an outer mounting ring that is aligned with bars that are spaced together and run approximately parallel. Each of the bars defines the passage openings that are uni-directionally bounded over the running passage cross section, whereby the passage openings are arranged together next to the mounted elements shifted in the circumference direction of the mounting housing. With the help of the mounted elements designed in the jet regulators already known, complex structures can be created that heavily reduce the flow rate and a smooth bubbling water jet in the form of mesh or cascades, whereby the mounted elements with a low cost that can be manufactured by means of conventional production technologies do not lead to an undesired calcification. In order to achieve an effective speed reduction of the flowing water, it is recommended that the bars of each mounted element be arranged with one another at the smallest distance possible. If this distance between the bars of a mounted part is measured as too small, however, the danger exists that the particles of dirt flowing with the supply network cannot slip through between the bars and thus can increasingly compromise the function of the already-known jet regulator.

Thus exists the particular objective of creating a sanitary component of the type mentioned at the beginning that can be manufactured in a cost-effective manner and is sure to function, that allows the best possible flow-regulation characteristics and with a comparatively small cross-sectional surface.

According to the invention, the solution to this objective is provided by the sanitary component of the type mentioned in the beginning, characterized in that the bars of at least one component are arranged in a grid or mesh and cross at junction points.

SUMMARY

The component according to the invention possesses a jet regulating device in the interior of its mounting housing that has at least one mounted element that can be directly mounted in the mounting housing. This mounted element, of which there is at least a single instance, possesses bars oriented transverse to the direction of flow, which, according to the invention, are arranged in a grid or mesh and cross at junction points. By means of this grid or mesh structure the mounted element, of which there is at least a single instance, can also possess a multitude of bars on a comparatively small cross-sectional surface that divides the flowing water flow into a multitude of individual jets. Consequently, an effective mixture and jet regulation can be achieved with high flow-through capacity on a comparatively small cross-sectional surface with limited manufacturing expense. In addition, a multitude of bars allows these to be arranged together in a grid or mesh such that the passageways are nevertheless sufficiently large to allow particles of dirt carried along in the fluid flow to pass therethrough.

The component according to the invention is constructed as a jet regulator in a preferred embodiment. An additional design according to the invention provides that the jet regulating device on the inflow side of a jet separating device is upstream for the separation of the flowing fluid flow into a multitude of individual jets, and at least one mounted element of the jet regulating device is arranged relative to the jet separating device such that the individual jets impinge upon the junction points of at least one of the mounted elements. A deceleration of the flowing fluid and a separation of the individual jets flowing into the jet regulating device can be achieved particularly if the individual jets impinge upon the junction points of at least one of the mounted elements.

The jet separating device of the mounted element according to the invention can be arranged as a deflector, for example. An inordinate noise development will be avoided if the jet separator device is provided as a perforated plate.

In order to increase the segmentation of the individual jets even more, and in order to improve the jet regulating characteristics on small cross-sectional surface even more, it is advantageous if at least two neighboring mounted elements are provided with bars arranged in a grid or mesh. These mounted elements also have crossing bars at junction points that segment the flowing water flow into a multitude of individual jets. However, the individual water jets are once again effectively divided at the junction points of the mounted elements in such a way that an effective mixing and jet regulation can also be achieved for high flow-through capacities on a comparatively small cross-sectional surface. Thus, the component according to the invention also features the best possible jet regulating characteristics as well as a small cross-sectional surface.

At the same time, an embodiment according to the invention is provided such that the bars and the junction points of at least two neighboring mounted elements are aligned with one another. A particular advantage of such an embodiment form is that at least two mounted elements can be constructed in the same way.

For another embodiment according to the invention that has been studied further that features a particularly effective segmentation of the water jets in the smallest amount of space, it is provided that the passageways of a mounted element are downstream of the junction points of the neighboring mounted element in the direction of the flow.

An embodiment according to the invention is provided that is simple and that can be manufactured at limited expense that is arranged in the form of a grid on a mounted element, at least on the inflow- and/or outflow side, and possesses two parallel grid bars that cross groups. A mounted element on the inflow- and/or outflow side can have, in addition or instead, a group of radial bars that cross circumferentially extending concentric bars that are in the form of a ring at the junction points with a group. According to an additional embodiment according to the invention it is provided that at least one mounted element on the inflow- and/or outflow side has crossed bars in the form of a star or a mesh.

An arrangement of the components according to the invention that also saves space in an axial direction provides that the bars of at least one of the mounted elements are arranged in a level that is preferably oriented transverse to the direction of flow, and the mounted elements in particular are arranged in the form of discs.

In order to combine on the outflow side the individual jets that are created in the jet regulating device into a homogenous, aggregate jet that does not spray, it is advantageous if the jet regulating device on the inflow side is downstream of a flow regulator that possesses passage openings whose opening width is smaller than the level in the direction of flow. At the same time it is particularly expedient if the flow regulator is arranged at the discharge end of the mounting housing.

The flow regulator can be connected in one piece with the mounting housing or be directly mounted as a separate mounted element in the mounting housing. While a flow regulator directly mounted as a separate mounted element in the mounting housing still supports the modular construction of the component according to the invention, a flow regulator connected in one piece also serves as a protection against vandalism on the outflow side of the component.

The flow regulator of the component according to the invention can be adjusted in its arrangement based on the particular application and the objective of the application. Thus it is provided that the flow regulator has passage openings that are rectangular, in the form of a segment of a circle or in the form of a honeycomb.

However, it is also possible that the flow regulator and/or the jet regulating device possess at least one metal filter. The component according to the invention is designed as a jet regulator in a preferred form of application.

An additional design of significance according to the invention that is particularly worthy of protection is provided for a component arranged as a jet regulator, in which the mounting housing is divided into at least two housing parts, the housing parts can be combined with one another, and a housing part on the inflow side is intractably and solidly connected with the jet separating device.

For this embodiment, the mounting housing is divided into at least two housing parts and thus a housing part on the inflow side as well as the outflow side. From these housing parts a housing part on the inflow side is connected solidly and intractably with the jet separating device. Since a comparatively sensitive jet separating device is also connected securely, solidly and protected with the housing part, no material distortion of the jet separating device that compromises the function is to be expected for hot water temperatures and high water pressures. Since the jet separating device is held solidly and intractably to the housing interior, and since a ring flange is no longer necessary as a support there, the jet regulator can also be shaped for high flow-through capacities with a comparatively small housing diameter, as it was only possible with jet regulators with limited flow-through capacity with the state of the art already known. By means of the jet separating device solidly connected with the mounting housing, the mounting housing experiences a radial stiffening that also makes the mounting housing in the form of sleeves generally stable in form and against ruptures. While for jet regulators already known, in which a separate perforated plate was mounted to the housing exterior as a jet separating device, constant thickness problems occurred between the perforated plate and exterior housings in the form of sleeves; the jet regulator according to the invention offers the material advantage that these thickness problems do not exist on the basis of the one-piece nature between the jet separating device and housing parts on the inflow side. Since the mounting housing is formed of at least two housing parts that can be combined with one another, the jet separating device can nevertheless be introduced in the direction of the flow downstream of the jet regulating device and, if applicable, additionally required functional units can be introduced in the mounting housing. The component designed as a jet regulator according to the invention thus features at the same time a high level of stability in form with limited manufacturing expense.

Insofar as an intense or less intense deceleration of the water flow is desired in the component according to the invention, an adjustment of the component is possible by means of the substitution of the jet regulating device as well as of its downstream functional units. A preferred embodiment according to the invention thus provides that the mounting housing consisting of at least two housing parts that can be combined with one another is assigned at least two jet regulating devices that can be optionally mounted directly in the mounting housing.

The housing part on the inflow side of the component arranged as a jet regulator can be manufactured at limited expense as a single-piece plastic injection-molded part if the jet separating device is connected in one piece with the housing part assigned to it.

The expense connected with the manufacture of the component can be reduced even more if the mounting housing has two housing separable parts that can be combined with one another in an direction that is oriented transverse to the direction of the flow.

The housing parts of the component according to the invention can be combined with one another particularly simply and conveniently if these housing parts of the mounting housing can be connected in a detachable manner. However, it is also possible instead to solidly connect at least two housing parts with one another, for example, by means of an adhesive- or welded connection.

A preferred embodiment according to the invention provides that a housing part on the outflow side is arranged in the form of sleeves and that at least one mounted element of the jet regulating device can be mounted directly in this housing part. At the same time it is advantageous if at least one mounted part in the jet regulating device assigned housing part from whose inflow side out up to a plug stop or a support can be directly mounted.

In order to be able to easily adjust the component according to the invention to the different requirements for use of the same mounting housing, this mounting housing can be assigned additional, optional jet regulating devices that can be directly mounted in the mounting housing. In addition or instead, it is possible that the jet regulating device of the jet regulator is constructed modularly and its multiple, optional mounted elements that can be combined with one another are assigned.

A preferred embodiment according to the invention provides that the outlet housing part in the area of the water discharge opening possesses at least a soft and/or water-repellent surface. The advantage of this embodiment consists of the freedom from calcification in the area of its water discharge opening. Furthermore it particularly allows for easy cleaning of a soft surface by means of manual removal of possible deposits.

On the same grounds it can be advantageous if, in addition or instead, the housing part on the outlet side is manufactured out of an elastic material at least in the area of the water discharge opening. At the same time rubber, silicon, thermoplastic elastomers or other flexible materials are preferred for use.

In order to promote the simple manufacturability of the jet regulator according to the invention in the area of its housing part on the outlet side as well, it is advantageous if the housing part on the outlet side is manufactured principally out of rubber-elastic material and/or a material with a soft or water-repellent surface.

Also for this reason, a housing part manufactured out of rubber-elastic material is sufficiently stable and can be fixed, for example, to the neighboring housing part by means of a snap-on connection; it is advantageous if the housing part on the outlet side is braced by means of longitudinal bars in the circumferential direction that are preferably uniformly distributed.

At the same time a preferred embodiment according to the invention provides that the longitudinal bars are provided at least in the area of the discharge opening.

A particularly advantageous additional design according to the invention that is particularly worthy of protection provides that the housing part on the outlet side in the area of the water discharge opening possesses at least a constriction or similar narrowing of its flow-through cross section. This constriction or similar narrowing of the flow-through cross section has a calibrating effect on the out-flowing water jet and the pattern of its jet. The narrowing of the flow-through cross section is in the area of the water discharge opening, and it is consequently provided that possible noise contours are provided in an area downstream in the direction of the flow. By means of the calibration of the water jet, a jet pattern that is homogenous and that does not spray is materially fostered.

In order to still further simplify the manufacture of the jet regulator according to the invention, it is advantageous if the housing part on the outlet side can be combined with the neighboring housing part on the inflow side, preferably via a particular rotary snap-on connection.

BRIEF DESCRIPTION OF THE DRAWINGS

Additional characteristics of the invention result from the following description of exemplary embodiments according to the invention in connection with the claims as well as the illustration. The individual characteristics can each be realized individually or in combination to form an embodiment according to the invention.

Shown are.

DETAILED DESCRIPTION OF THE PREFERRED EMBODIMENTS

Figure 1:
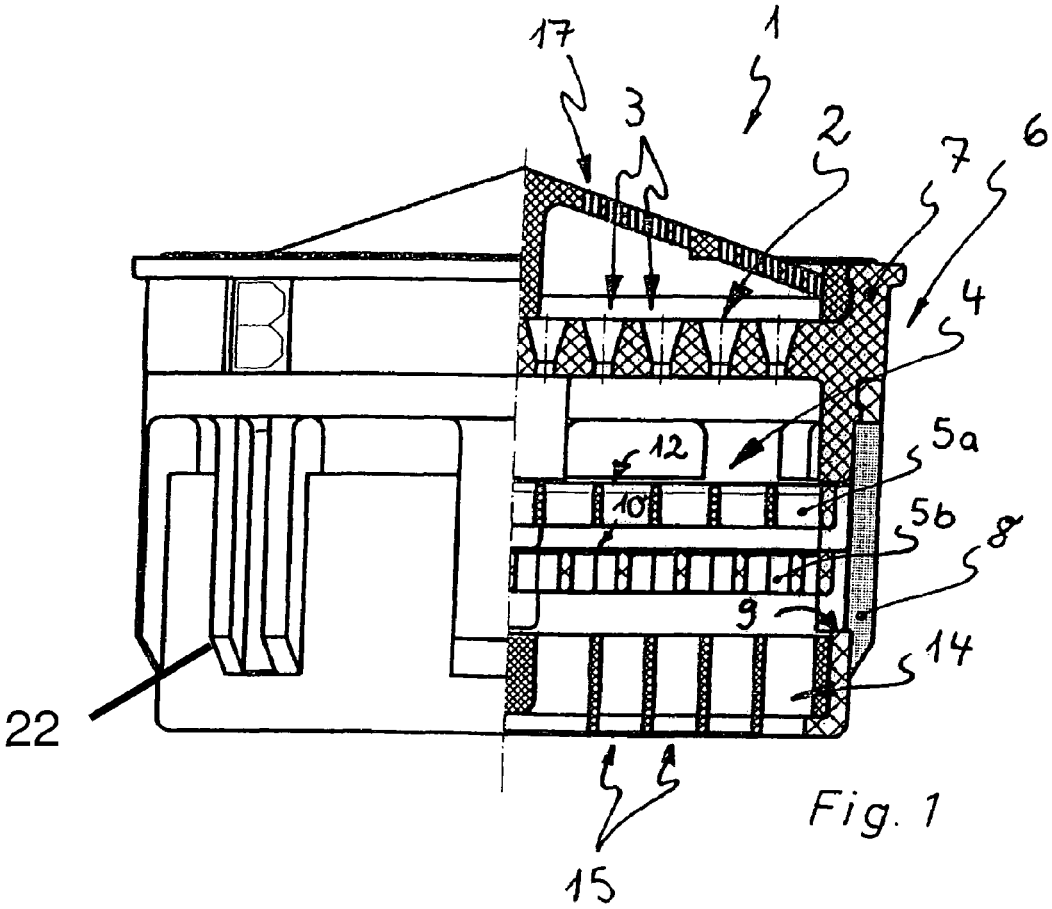
FIG. 1 a sanitary component shaped as a jet regulator in a longitudinal section that possesses a jet separating device on the inflow side that is downstream in the flow-through direction of a jet regulating device that has multiple mounted elements spaced apart from one another whereby a flow regulator forms the front side of the outflow side of this jet regulator, FIG. 2 a mounted element of the jet regulating device in a top view (FIG. 2*a*) and in a longitudinal section (FIG. 2*b*), whereby the mounted element has crossing bars in the form of a grid at junction points, FIG. 3 a mounted element comparable with FIG. 2 in a top view (FIG. 3*a*) and in a longitudinal section (FIG. 3*b*), FIG. 4 the mounted elements combined with one another on the jet regulating device from FIGS. 2 and 3 in a top view, FIG. 5 a mounted element in a top view (FIG. 5*a*) and in a longitudinal section (FIG. 5*b*) that has two groups at junction points of crossing bars, whereby one group possesses concentric rotary bars while a second group is formed of radial bars, FIG. 6 a mounted element in a top view (FIG. 6*a*) and in a longitudinal section (FIG. 6*b*); said mounted element has bars connected with one another in a mesh at junction points, FIG. 7 a mounted element comparable with FIG. 5 in a top view (FIG. 7*a*) and in a longitudinal section (FIG. 7*b*), FIG. 8 the mounted elements combined with one another at the jet regulating device from FIGS. 5 and 7 in a top view, FIG. 9 a flow regulator that can be mounted directly in the housing of the mounted element with honeycombed flow openings in a top view (FIG. 9*a*) and in a longitudinal section (FIG. 9*b*), FIG. 10 a flow regulator functionally comparable with FIG. 9 in a top view (FIG. 10*a*) and in a longitudinal section (FIG. 10*b*), whereby the flow regulator has flow openings in the form of a segment of a circle, FIG. 11 a filter mounted part whose bars are formed by means of a metal filter, whereby the mounted part can be mounted directly in the mounting housing in addition to or instead of the mounted elements illustrated in the FIGS. 2, 3, 5, 6 and 7 and/or in addition to or instead of the flow regulator shown in the FIGS. 9 and 10, in a top view (FIG. 11*a*) and in a longitudinal section (FIG. 11*b*), FIG. 12 a mounted element functionally comparable with FIG. 11 in a top view (FIG. 12*a*) and in a longitudinal section (FIG. 12*b*), whereby the mounted element—as in FIG. 11—possesses here a metal filter oriented transverse to the direction of flow, FIG. 13 a top view of two mounted elements of a jet regulating device constructed in the same way, whereby the bars and the junction points of these neighboring mounted elements align with one another, FIG. 14 a jet regulator located in an outlet nozzle in a partial longitudinal section whose lower housing part is manufactured out of an elastic material in the form of sleeves, and FIG. 15 a jet regulator, similar to that in FIG. 1, whose jet separating device is here shaped as a deflector.

In FIG. 1 a sanitary component is illustrated that can be directly mounted in the outlet nozzle of a sanitary outlet armature. The mounted element is designed here as a jet regulator 1 that serves for the production of a homogeneous, smooth bubbling water jet that does not spray. For this purpose, the jet regulator 1 has a jet separating device 2 that can be designed as a deflector, for example, but preferably—as here—is shaped as a perforated plate and segments the flowing water flow into a multitude of individual jets. For this purpose, the perforated plate 2 has a corresponding number of flow-through holes 3 that narrow in a preferably conical manner at least on a perforated segment on the inflow side in the direction of flow. A pre-filter 17 on the inflow side is provided so that particles of dirt do not penetrate into the component 1 and cannot lead to functional failures there.

The jet separating device formed by means of the perforated plate 2 is a jet regulating device 4 in the direction of flow downstream. This jet regulating device 4 should strongly slow down the individual jets coming from the jet separating device 2, segment them into additional individual jets and, as the housing requires, foster an air mixture in order to obtain a smooth bubbling water jet in the end. For this purpose, the jet regulating device 4 possesses two mounted elements 5*a* and 5*b* that can be directly mounted with distance to one another in the mounting housing.

In FIG. 1 it is discernible that that the mounting housing 6 is arranged in two parts and has two connectable housing parts 7 and 8 that are detachable from one another. At the same time the housing part 7 on the inflow side is connected in one piece with the perforated plate 2 and for this reason is connected both solid and intractably. These housing parts 7 and 8 are detachably connected with one another in a separation plane oriented transverse to the direction of flow. Because a comparatively thin perforated plate 2 is also securely and solidly connected with the housing part 7 on its circumference edge, no material distortion that impairs the function of the perforated plate 2 is to be expected. Because the perforated plate 2 is held solidly and intractably to the interior of the housing, and because a ring flange as a support for the perforated place is not required there, the jet regulator 1 can also be arranged with a comparatively small housing diameter for high flow-through capacities as was possible with the known state of the art only for jet regulators with limited flow-through capacity. By means of the perforated plate 2 solidly connected with the mounting housing 6, the mounting housing 6 has a radial stiffening that also makes the mounting housing 6 in the form of a sleeve stable in form and against ruptures as a whole. Because the mounting housing is formed of at least two combinable housing parts 7 and 8 that are detachable from one another, the jet regulating device 4 of the perforated plate downstream in the direction of flow and, if necessary, additional required functional units can nevertheless be mounted in the mounting housing 6. The jet regulator 1 thus features a high stability in form and, at the same time, small manufacturing expense. The jet regulator 1 can also be arranged with a comparatively small housing diameter for high flow-through capacities. Insofar as different flow-through capacities require a corresponding adjustment of the jet regulator 1, it is possible by means of the substitution of the perforated plate 2 downstream of the jet regulating device and the similar functional units.

Figure 4:
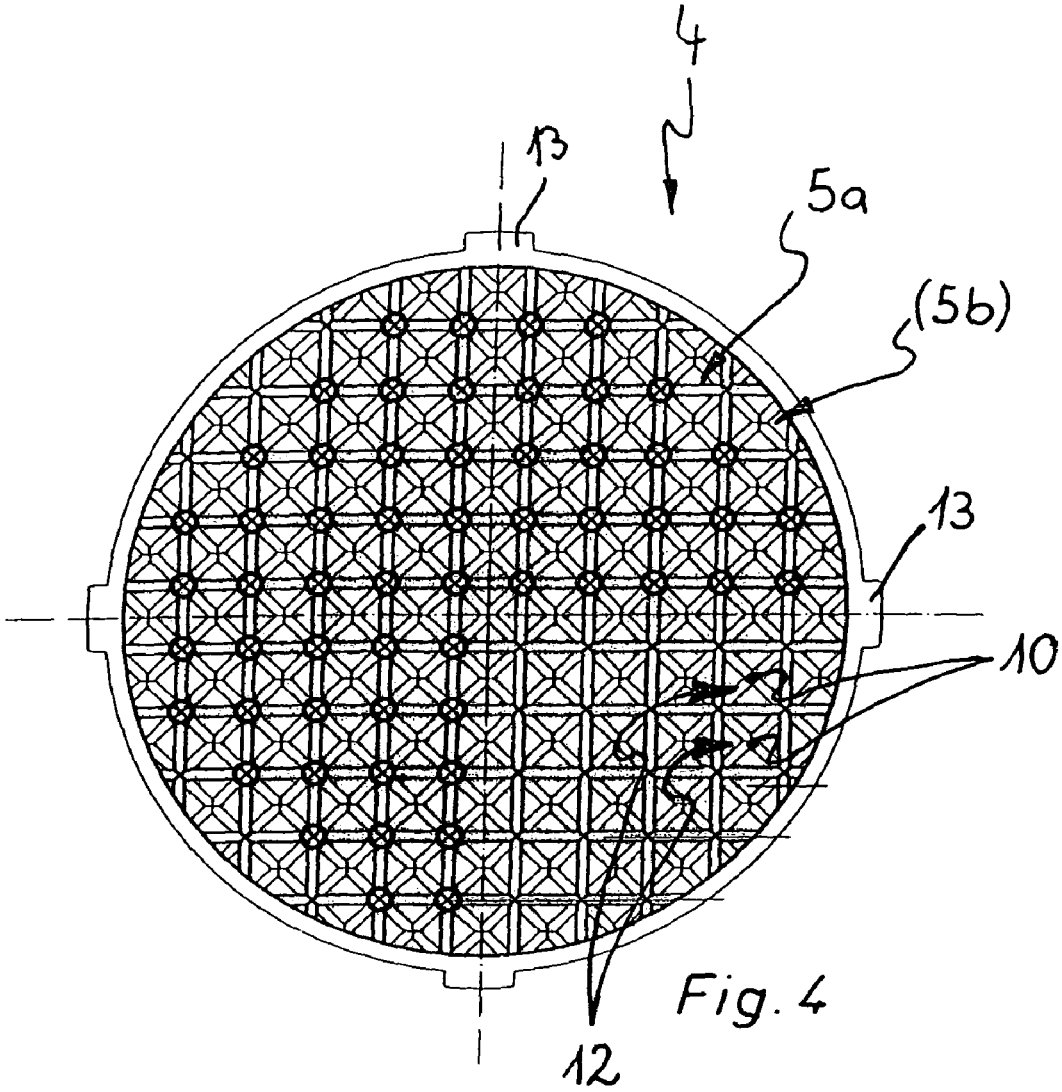
Figure 9A:
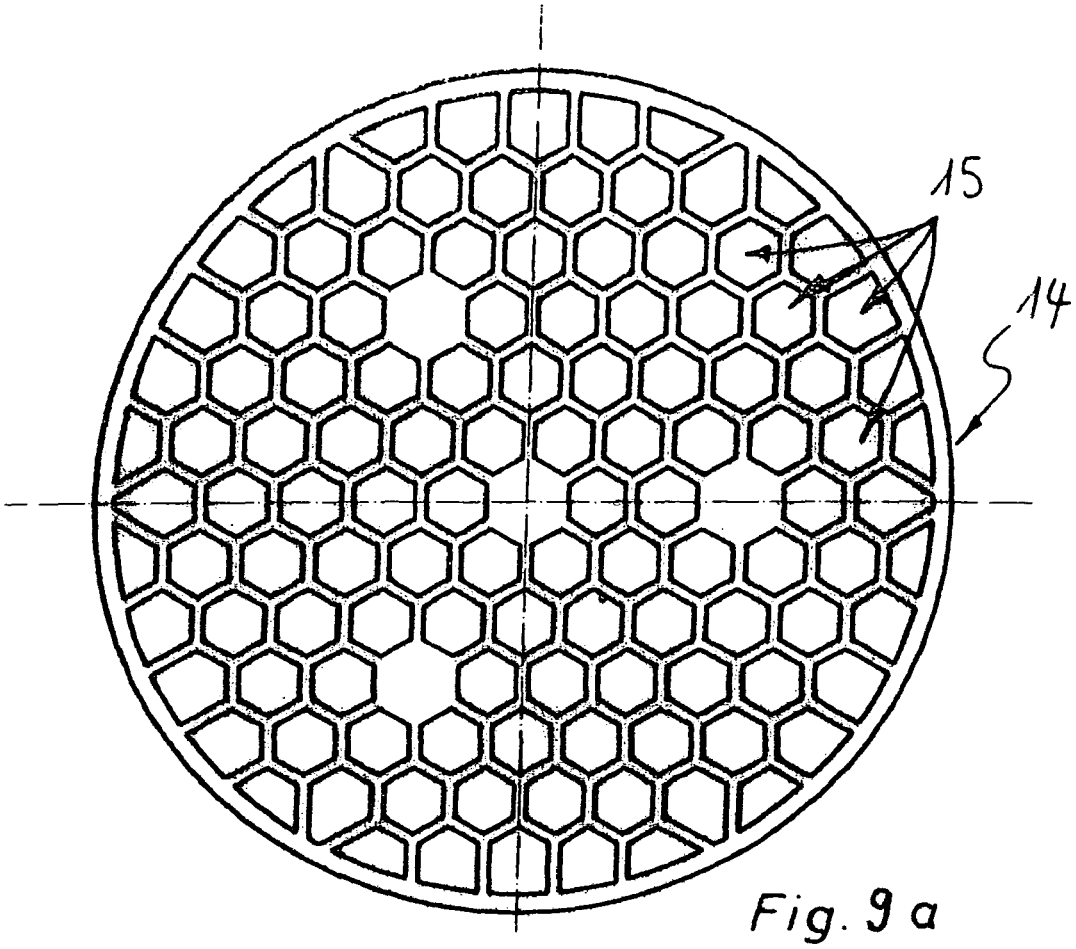
Figure 9B:
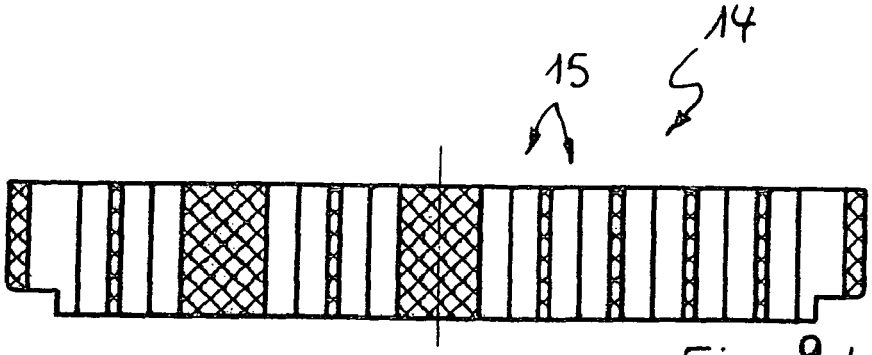

In FIG. 1 it is discernible that the housing part 8 at an outflow side is provided in the form of a sleeve and that in this housing part 8 the mounted elements 5*a* and 5*b* of the jet regulating device 4 can be directly mounted up to a plug stop 9. From a comparison of FIGS. 2 through 8 and in particular from the FIGS. 4 and 9 it is clear that the mounted elements 5*a* and 5*b* each have crossing bars 11 at junction points 10, whereby the passageways 12 of one of these mounted elements 5*a* are upstream from the junction points 10 of the neighboring mounted element 5*b* in the direction of flow, while at the same time the passageways 12 of the mounted element 5*b* at an outflow side are upstream from the junction points 10 of the neighboring mounted element 5*a* on the inflow side in the direction of flow.

The water jet on the inflow side that is arranged as a jet regulator of mounted element 1 is segmented at each junction point 10 of the mounted element 5*a* on the inflow side into multiple individual jets. These individual jets are again segmented into a multitude of additional individual jets at the junction points 10 of the mounted element 5*b* downstream in the direction of flow. The jet regulating device 4 of the jet regulator 1 shows its mounted elements 5*a* and 5*b* with the junction points 10 arranged in the form of cascades by means of a particularly effective deceleration of the inflowing water jet even for small cross-sectional surfaces.

The jet regulating device 4 of the jet regulator 1 illustrated here is constructed in a modular manner; the jet regulating device 4 is assigned multiple optional mounted elements 5 that can be combined with one another. Thus the mounted elements 5*a* and 5*b* illustrated in the FIGS. 2 and 3 possess bars 11 in the form of a grid. The grid structures of these mounted elements 5*a* and 5*b* are arranged at an approximately 45° offset to one another, whereby the mounted element 5*b* illustrated in FIG. 3 has a smaller grid distance in comparison to the mounted elements 5*a* from FIG. 2. By means of molds or processes appropriate to the situation 13 on the exterior circumference edge of the mounted elements 5*a* and 5*b*, that cooperate with complementary-shaped molds or processes appropriate to the situation that are oriented in a longitudinal direction on the housing circumference of the housing part 8, a device of the mounted element 5 that is appropriate to the situation is always ensured for one another in the mounting housing 6.

Figure 5A:
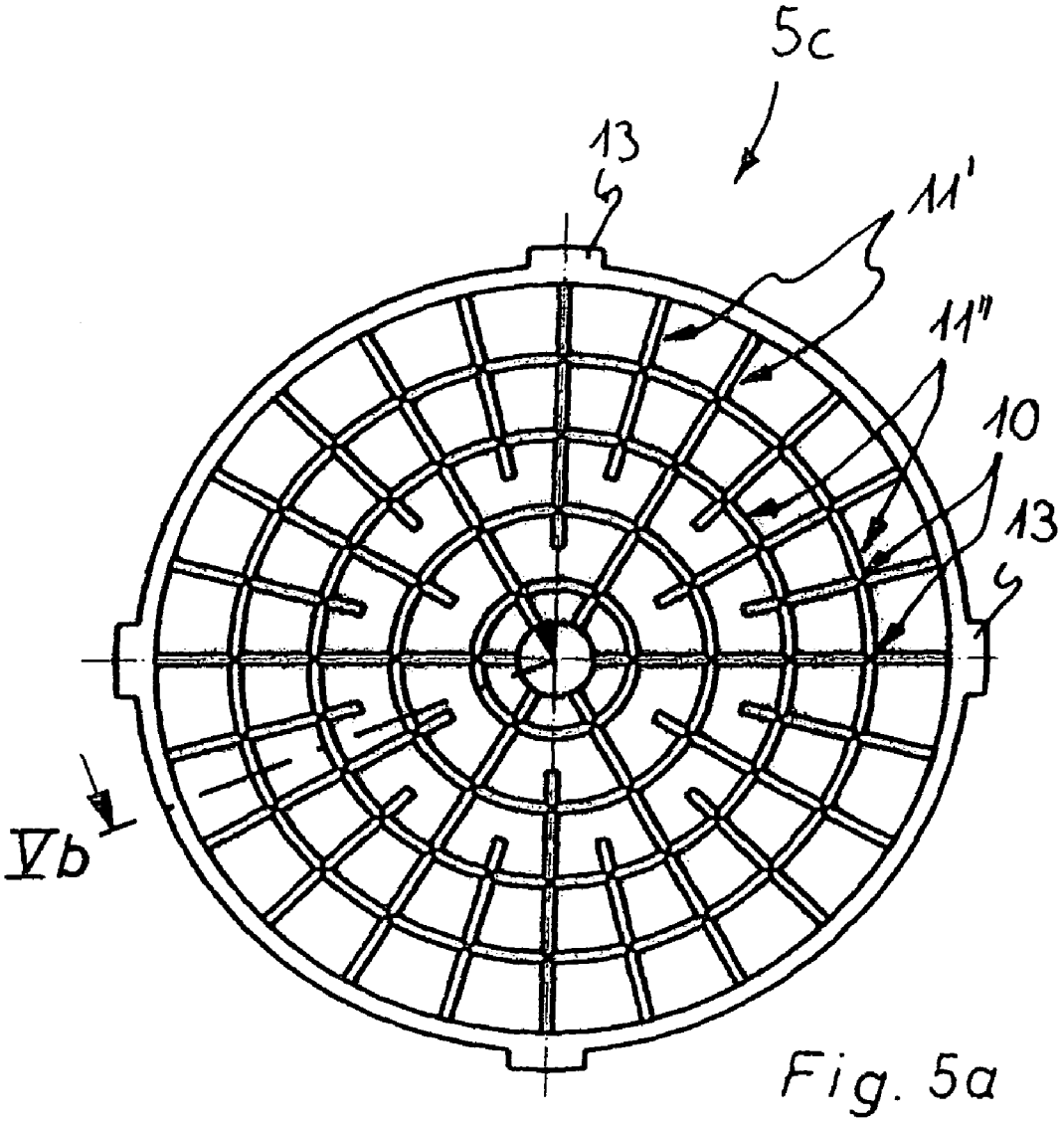
Figure 5B:
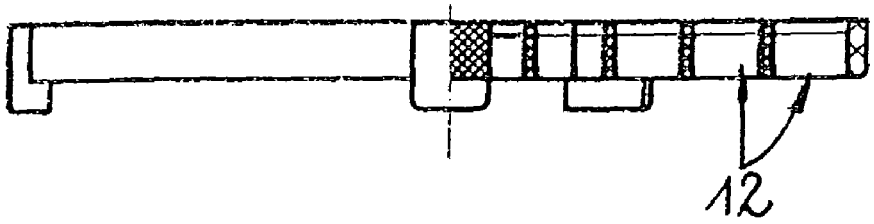
Figure 6A:
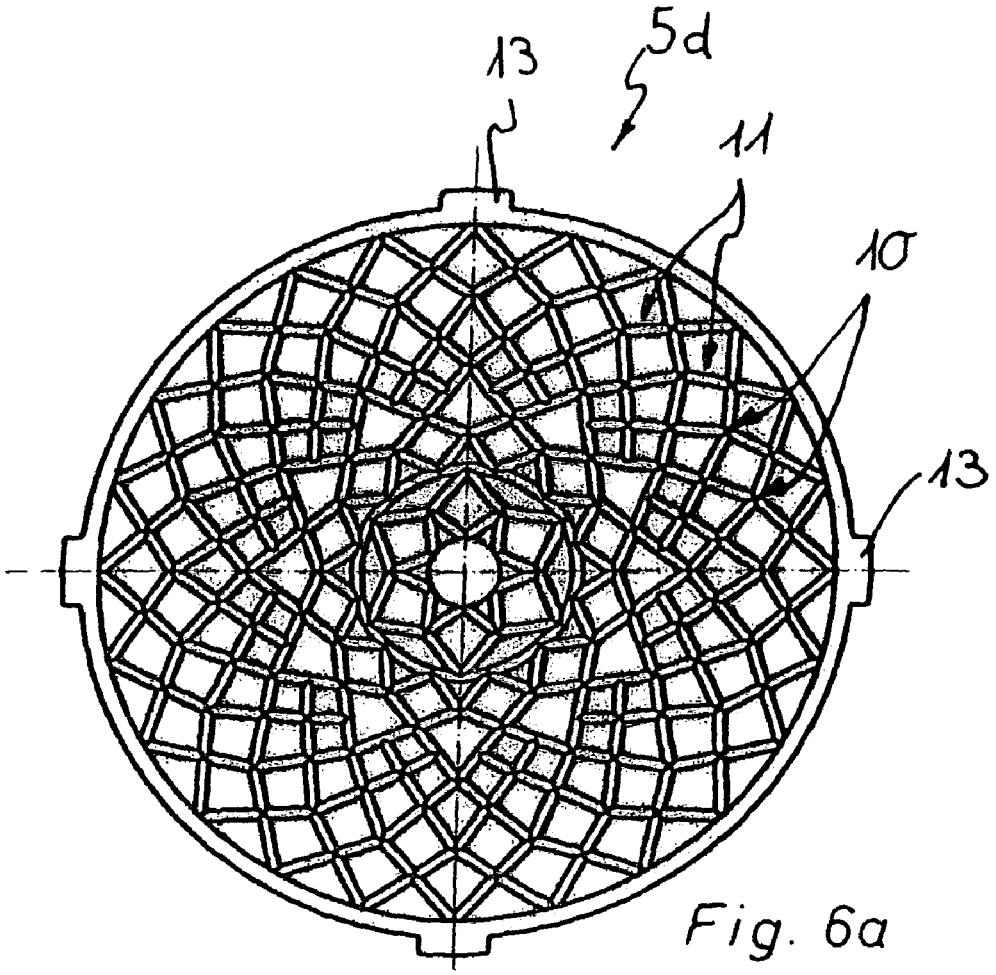
Figure 6B:
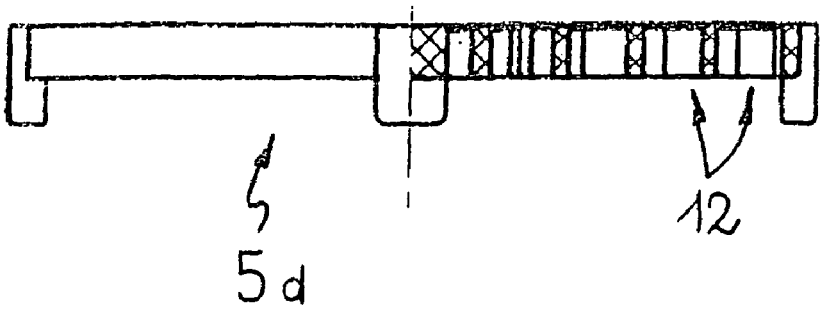
Figure 7A:
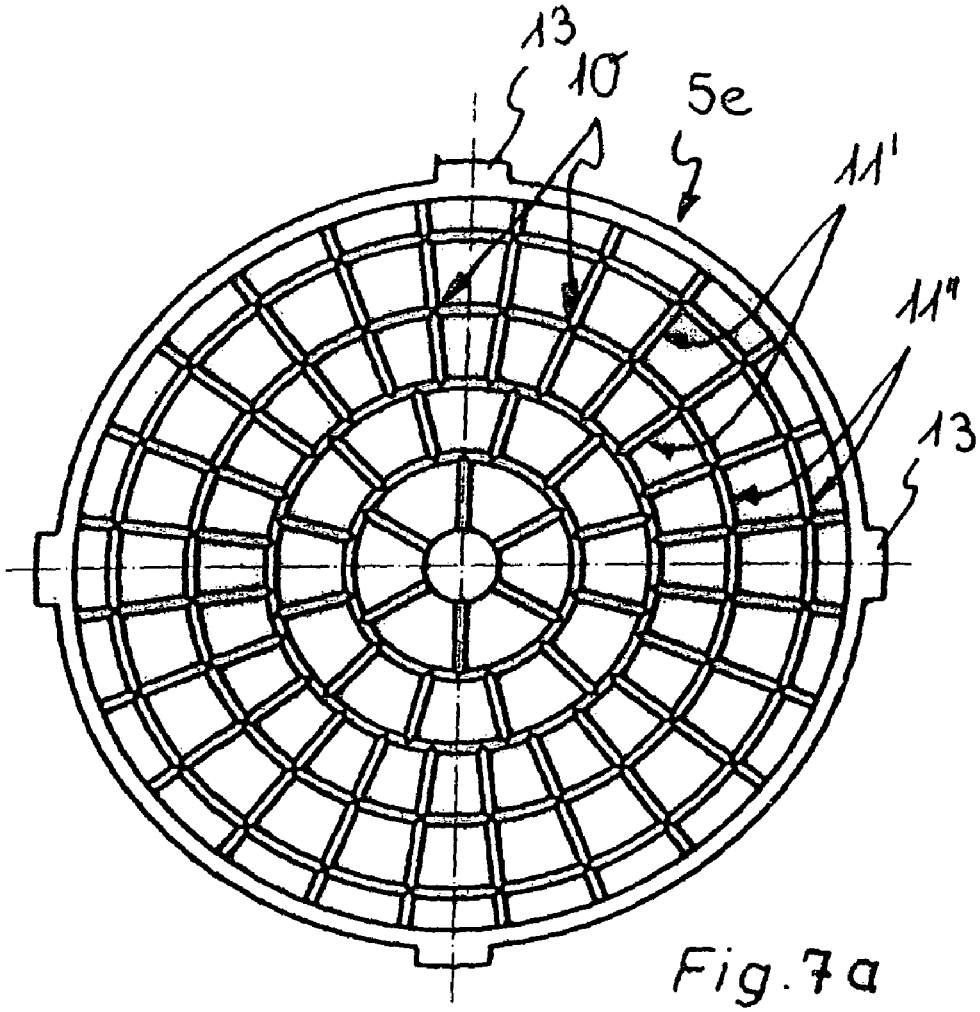
Figure 7B:
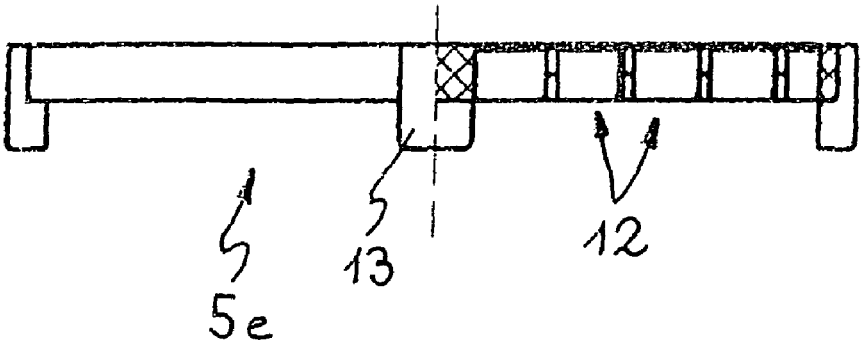
Figure 8:
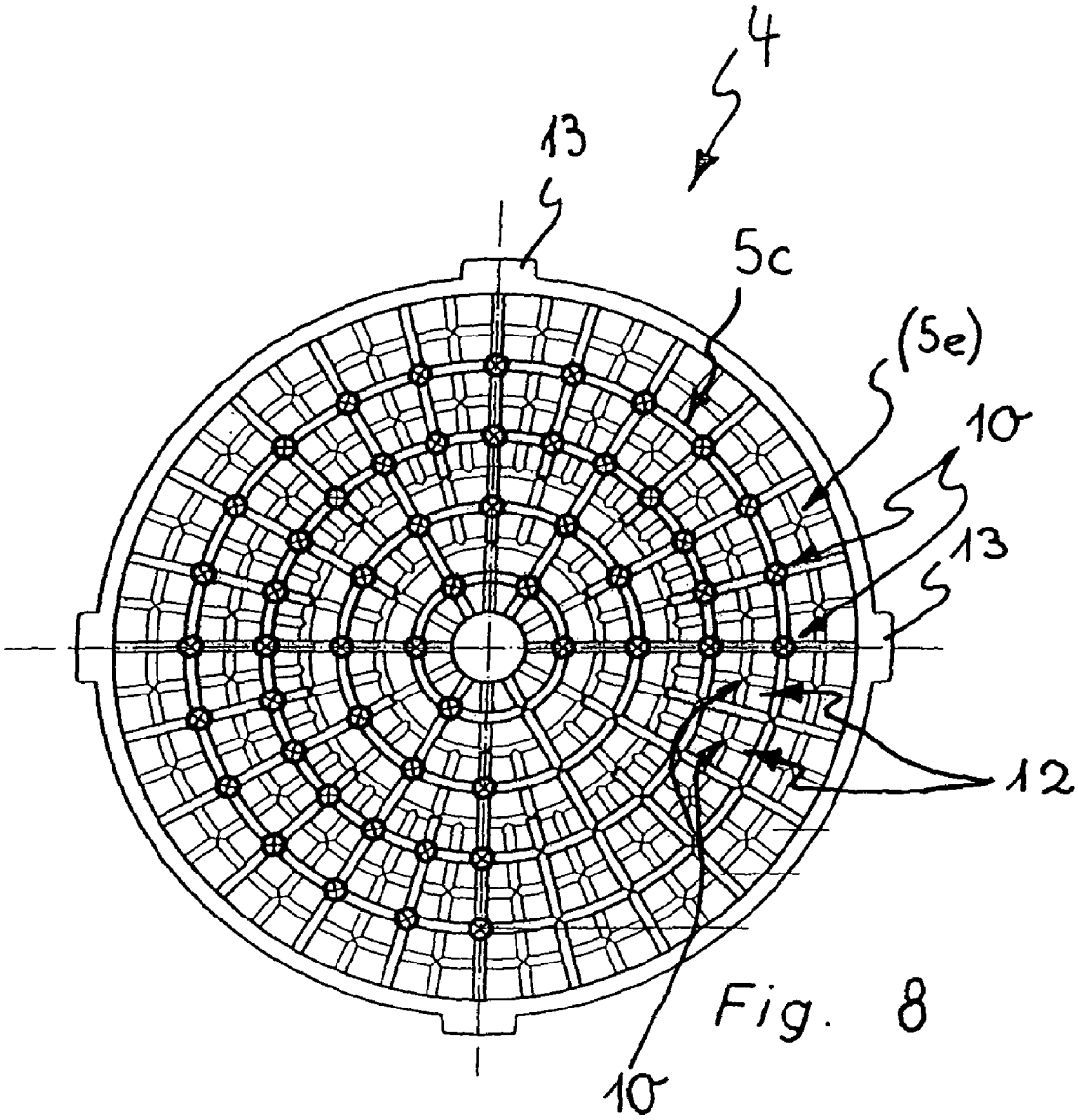

While the mounted element 5*c* on the inflow side illustrated in FIG. 5 possesses a group of radial bars 11' that cross themselves at the junction points with a group of concentric and rotary bars 11' in the form of a ring, the mounted element 5*d* on the outflow side shown in FIG. 6 has radial or mesh crossing bars 11. The bars 11 of each mounted element 5 arranged in the form of a disc are arranged in a layer oriented transverse to the direction of flow.

Figure 10A:
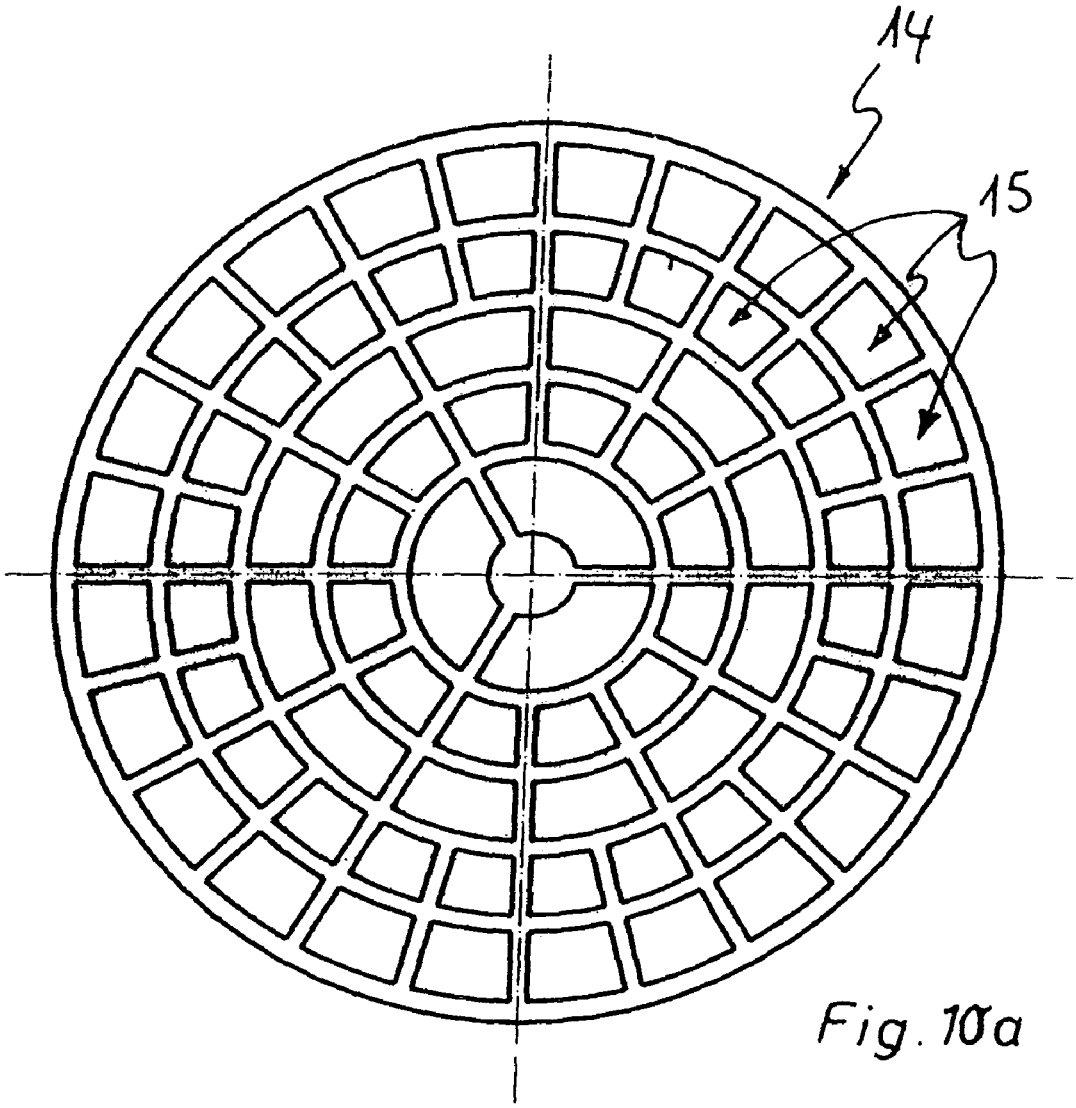
Figure 10B:
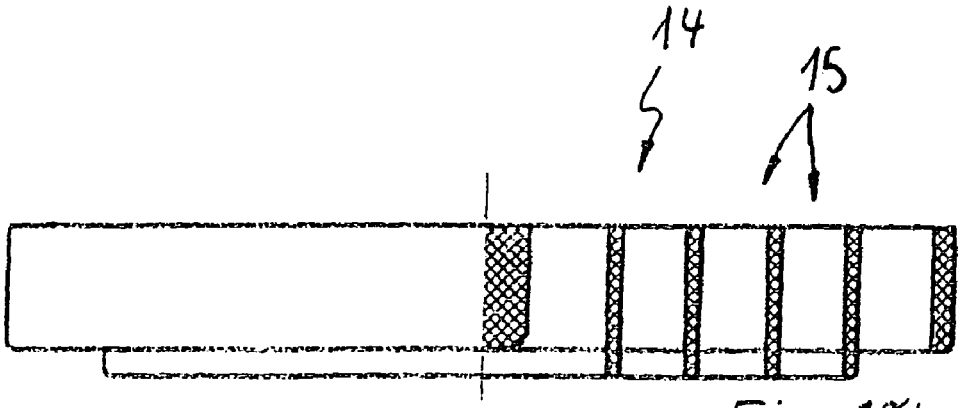

It is discernible in FIG. 1 that a flow regulator 14 is downstream from the jet regulating device 4 at the discharge end of the mounting housing 6. From a comparison of the FIGS. 9 and 10 it is clear that this flow regulator 14 can have passage openings 15 in which the opening width of the passage openings 15 is smaller than the depth in the direction of flow, for example, in the form of a honeycomb (FIG. 9) or in the form of a segment of a circle (FIG. 10).

Figure 11A:
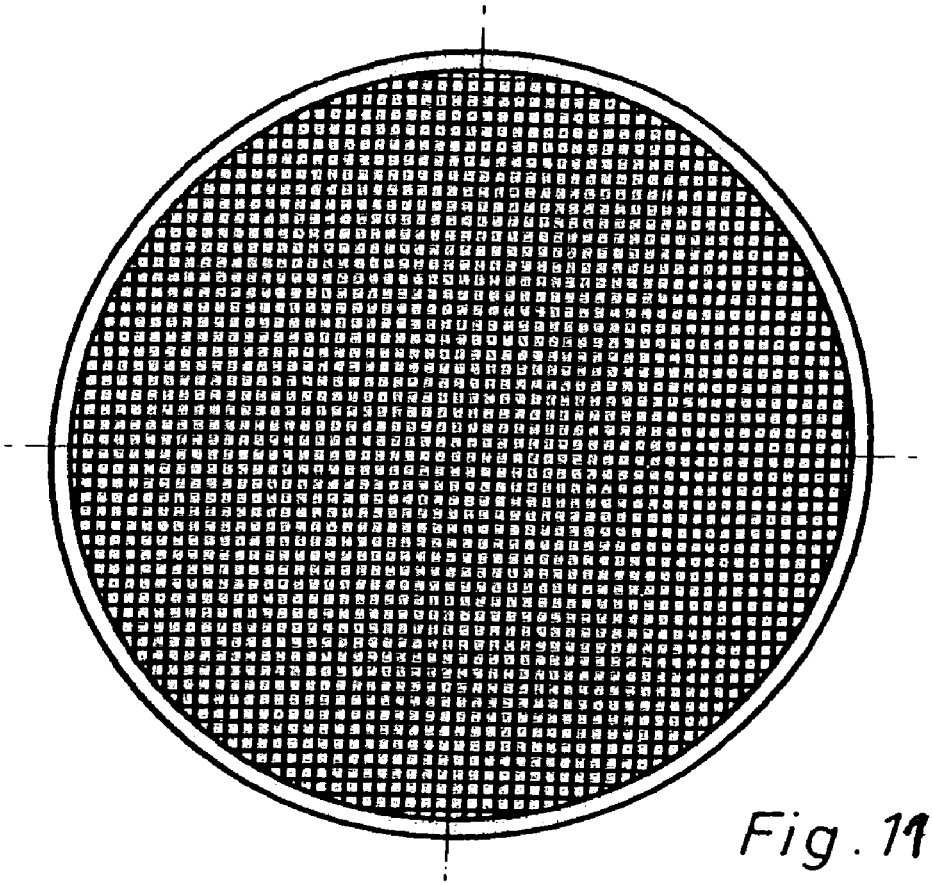
Figure 11B:
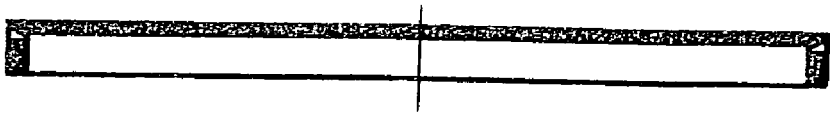
Figure 12A:
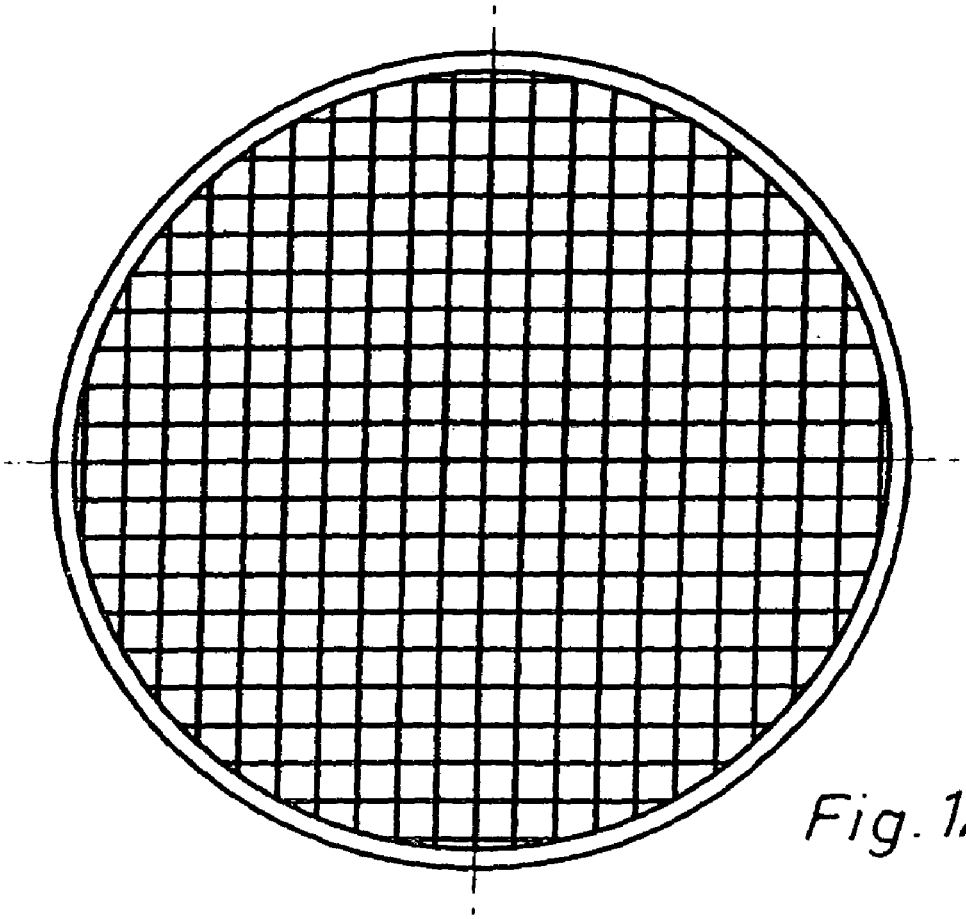
Figure 12B:
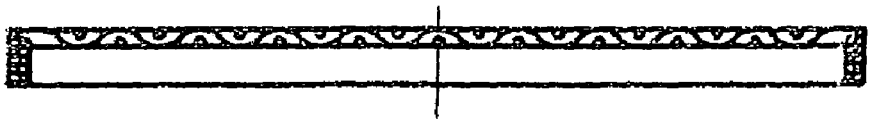
Figure 13:
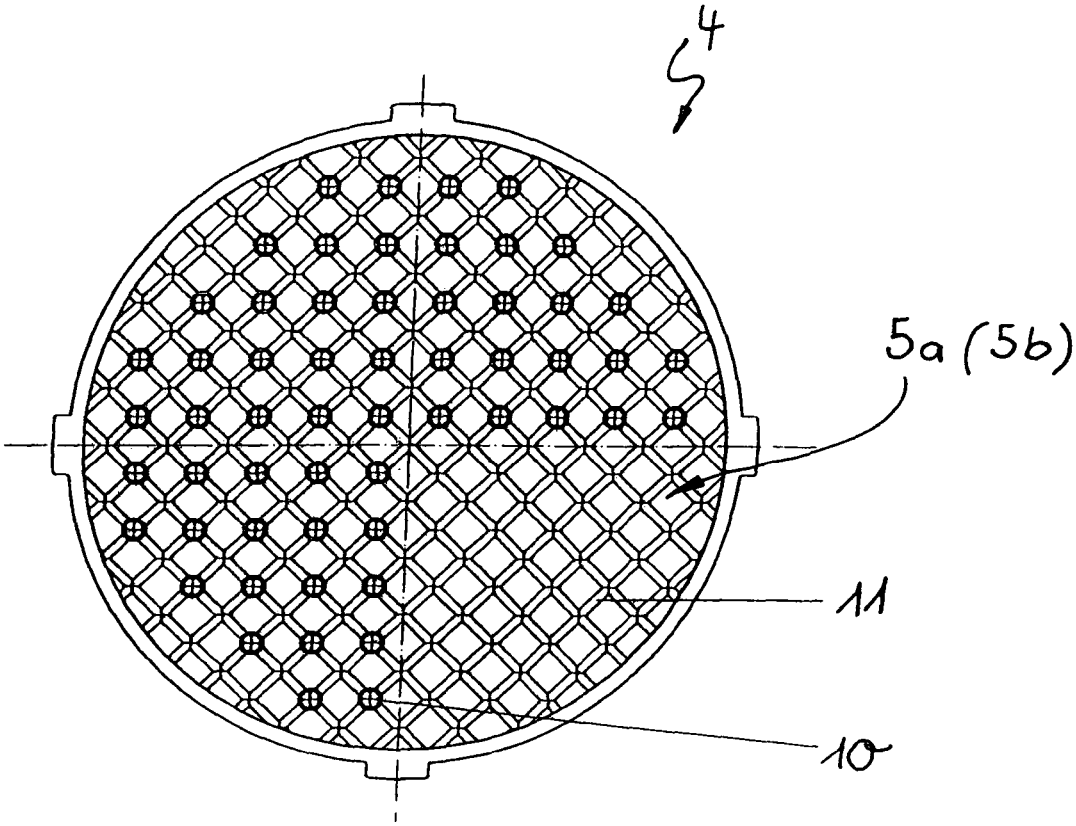

Insets serving here as flow regulators are illustrated in FIGS. 11 and 12, which possess a metal filter in the form of a grid. In FIG. 13 it is shown that the jet regulating device 4 can also possess two neighboring mounted elements 5*a* and 5*b*, whose bars 11 and junction points 11 align with one another. At the same time, it is clear from FIG. 13 the mounted elements 5*a* and 5*b* of one such jet regulating device 4 can also be shaped and constructed in the same manner, whereby the manufacturing expense can be reduced even more. Likewise as in the FIGS. 4 and 8, it is also implied in FIG. 13 by means of circles shown in bold print that the passage openings of the perforated plate align with the junction points 10 of at least one mounted element downstream in the direction of flow. By means of the circles shown in bold print in FIG. 13, the discharge point of the individual jets coming out of the jet separating device 2 is illustrated at the junction points 10 of the mounted elements 5*a*.

Figure 14:
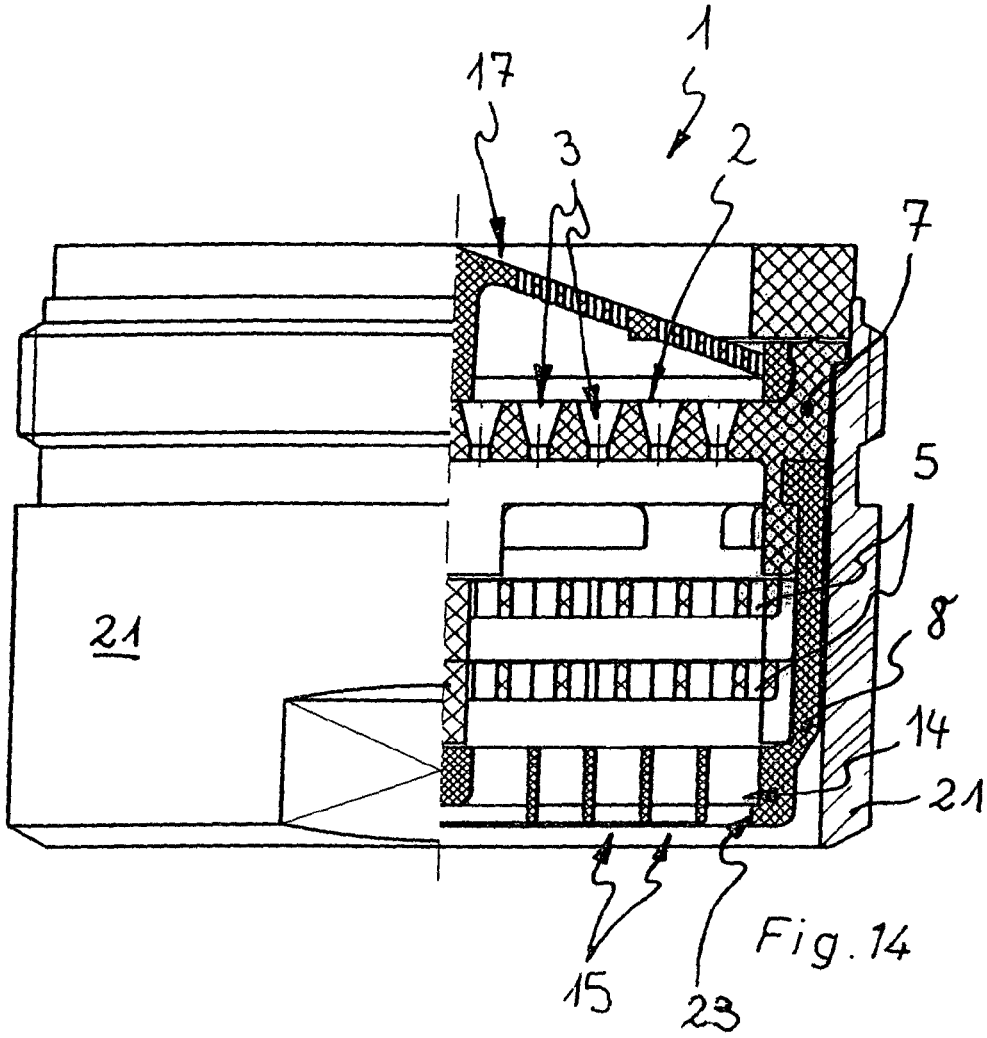

A jet regulator 1 located in an outlet nozzle 21 is illustrated in FIG. 14 whose housing exterior in the form of a sleeve is formed of two detachable housing parts 7 and 8 that can be connected with one another. At the same time the housing part 7 on the inflow side is connected for this reason both solidly and intractably with the perforated plate 2 in one piece. While the housing part 7 on the inflow side is formed of a comparatively solid plastic material, the housing part 8 on the outlet side is manufactured out of an elastic material and possesses a soft and water-repellent surface. Because the housing part 8 consequently has a water-repellent surface in the area of its water discharge opening and in the area of the flow regulator 14 provided there, the jet regulator 1 illustrated in FIG. 14 features the freedom from calcification of the flow regulator 14 on the outlet side. Because the housing part 8 on the outlet side is manufactured out of rubber, silicon or a thermoplastic elastomer and consequently has an elastic and soft surface, deposited calcification or dirt particles can be easily removed manually, in particular at the flow regulator 14. In order to further simplify the manual cleaning of the jet regulator 1; it can be advantageous if the jet regulator 1 protrudes at least slightly over the outlet nozzle 21 with a partition on the outlet side.

As is clear from FIG. 14, the housing part 7 on the inflow side and the housing part out on the outflow side are held to one another by means of a detachable snap-on connection. In order to prevent the housing part 8 on the outflow side from being able to be removed axially from the housing part 7 on the inflow side, the support shoulders on which both housing parts 7 and 8 rest are shaped such that sufficiently large forces can be absorbed. Furthermore, the housing part 8 on the outflow side is braced by means of radial longitudinal bars 22 that are arranged in the area of the flow regulator 14 and consequently equally distributed in the area of the discharge opening in the circumference direction. By means of the provided longitudinal bars 22 (FIGS. 1 and 15) on the flexible housing part 8 that very narrowly apply to the interior contour of the outlet nozzle 21, the flexible housing part 8 is prevented from widening and thus being removed from housing part 7. In any housing, the axial forces on the elastic housing part 8 resulting from the water pressure are comparatively small because the water pressure on the perforated plate in the housing part 7 serving as a jet separating device 2 is already almost completely exhausted.

In FIG. 14 it is discernible that the housing part 8 on the outflow side in the area of the water discharge opening possesses a constriction 23 that produces a narrowing of the flow-through cross section. By means of this narrowing of the flow-through cross section a calibration of the out-flowing water jet and a homogenization of the jet pattern is achieved. The constriction 23 is in the area of the water discharge opening and thus anticipated in an area that is downstream in the direction of flow of the possible noise contours. By means of the calibration of the water jet a spray pattern that is homogeneous and that does not spray is materially fostered.

Figure 15:
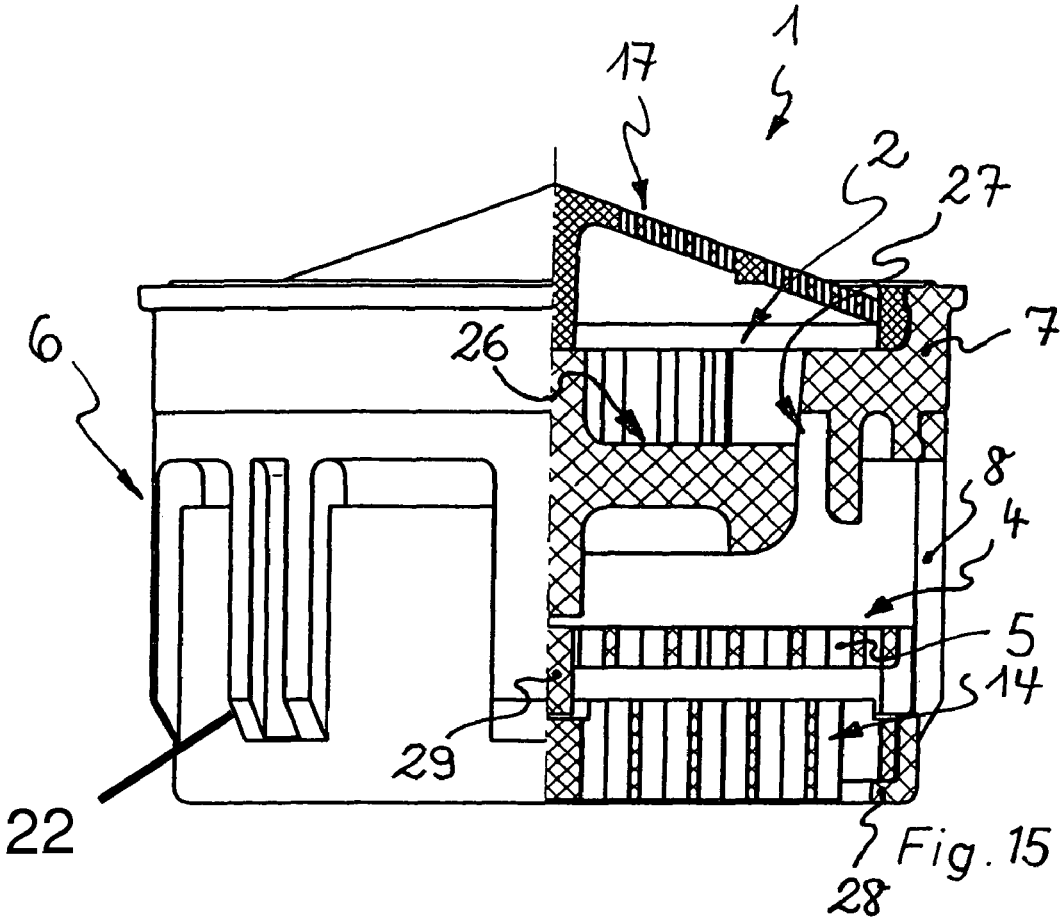

In FIG. 15, a jet regulator 1 that is comparable with FIG. 1 is illustrated. While the jet regulator that is shown in FIG. 1 possesses a perforated plate at a jet separating device 2, the jet separating device 2 of the jet regulator illustrated in FIG. 15 is designed as a deflector. The use of a jet separating device shaped as a deflector is provided if the noise development connected with it supporting a particularly effective deceleration of the inflowing fluid flow can be disregarded. From the partial longitudinal section in FIG. 15 it is clear that the inflowing fluid flow impinges upon a disc layer 26 that is arranged transverse to the direction of inflow respective to the longitudinal axis of the jet regulator. From this disc layer 26, the fluid flow flows out in a radial direction to the passage openings 27 that are provided on the rotary circumference wall at the disc layer 26. The fluid flow that is segmented into individual jets in the passage openings 27 can subsequently flow further to the jet regulating device 4 and/or to the flow regulator 14 that is downstream of the jet separating device 2 in the direction of flow.

The jet regulator illustrated in FIG. 15 likewise possesses a mounting housing 6 that is divided into two detachable housing parts 7 and 9 that can be connected with one another. While the housing part 7 on the inflow side is solidly and intractably connected with the jet separating device 2 that is shaped as a deflector, in the housing part 8 in the form of a sleeve on the outflow side, two mounted elements are mounted, both of which have flow-through openings in the form of honeycombs. While the mounted element 5 on the inflow side that is comparatively thin and is provided with small flow-through openings to serve as a jet regulating device, the mounted element on the outflow side which, on the other hand, is thicker and is provided with larger flow-through openings, forms a flow regulator that forms the individual jets into a homogeneous aggregate jet. At the same time, the mounted element that forms the outflow side of the flow regulator overlays on a radial circumference edge 28 of the housing part 8, while the mounted element 5 on the inflow side supports itself with a central spacer 29.

The invention claimed is:

1. Sanitary component (1) having a jet regulating device (4) in an interior of a mounting housing, the jet regulating device (4) comprising: at least one mounted element mountable in the mounting housing, that has bars (11) oriented transverse to a direction of flow, between which passageways (12) are defined, wherein the bars (11) of at least two neighboring mounted elements (5*a*, 5*b*, 5*c*, 5*d*, 5*e*) are arranged in the form of a grid or mesh, which cross at junction points (10) located in a single plane.

2. Component according to claim 1, wherein the jet regulating device (4) on an inflow side is downstream from a jet separating device, for the separation of the inflowing fluid flow into a multitude of individual jets and the at least one mounted element (5*a*, 5*c*) of the jet regulating device (4) is arranged relative to the jet separating device such that the individual jets impinge upon junction points (10) of the at least one mounted element (5*a*, 5*c*).

3. Component according to claim 2, wherein the jet separating device is shaped as a perforated plate (2).

4. Component according to claim 1, wherein the bars (11) and the junction points (10) of the at least two neighboring mounted elements (5*a*, 5*b*) align with one another.

5. Component according to claim 1, wherein the at least two of the at least one mounted elements (5*a*, 5*b*) are structurally identical.

6. Component according to claim 1, wherein the passageways (12) of one of the at least one mounted elements (5*a*, 5*c*) are upstream of the junction points (10) of a neighboring mounted elements (5*b*, 5*e*) in the direction of the flow.

7. Component according to claim 1, wherein at least one inflow side or one outflow side mounted element is arranged in a plane that is oriented transverse to the direction of flow.

8. Component according to claim 1, wherein a mounted element (5*a*, 5*b*) at an inflow- or outflow side is arranged in the form of a grid and comprises two groups of parallel grid bars (11) that cross one another.

9. Component according to claim 1, wherein one of the at least one mounted element (5*c*, 5*e*) at an inflow- or outflow side has a group of radial bars (11') that cross at the junction points (10) with a group of rotary bars (11") that are concentric and in the form of a ring.

10. Component according to claim 1, wherein one of the at least one mounted element (5*d*) at an inflow- or outflow side has bars (11) that cross in a star-shape or in the form of a mesh.

11. Component according to claim 1, wherein the bars (11) of at least one of the at least one mounted element (5) are arranged in a plane oriented transverse to the direction of flow.

12. Component according to claim 1, wherein the at least one mounted element (5) is shaped in the form of discs.

13. Component according to claim 1, wherein the jet regulating device (4) is upstream of a flow regulator (14), the flow regulator (14) comprising passage openings (15) whose opening width (15) is smaller than a height thereof in the direction of flow.

14. Component according to claim 13, wherein the flow regulator (14) is attached at the discharge end of the mounting housing (6).

15. Component according to claim 13, wherein the flow regulator (14) is connected in one piece with the mounting housing (6) or can be directly mounted in the mounting housing (6) as a separate mounted element.

16. Component according to claim 13, wherein the flow regulator (14) comprises through passage openings (15) that are rectangular, in the form of segments of a circle or in the form of a honeycomb.

17. Component according to claim 3, wherein the mounting housing is divided into at least two housing parts (7, 8), such that the at least two housing parts (7, 8) are detachably connectable with one another, and such that one of the at least two housing parts (7) at an inflow side is fixed and nondetachably connected with the perforated plate (2).

18. Component according to claim 17, wherein the jet separating device (2) is integral with one of the at least two housing parts (7).

19. Component according to claim 1, wherein the mounting housing (6) has two housing parts (7, 8) that are detachable and that can be combined with one another and oriented in a parting plane transverse to the direction of flow.

20. Component according to claim 1, wherein the mounting housing (6) comprises at least two housing parts (7, 8) that are detachably connected with one another.

21. Component according to claim 1, wherein the mounting housing comprises a housing part (8) at an outflow side arranged in the form of a sleeve and the at least one mounted element (5) of the jet regulating device (4) is mountable therein.

22. Component according to claim 21, wherein the at least one mounted element (5) of the jet regulating device is insertable into a corresponding housing part (8) and abuts a plug stop (9) or a support.

23. Component according to claim 1, wherein the mounting housing comprises at least two housing parts (7, 8) that can be combined with one another and in which at least two jet regulating devices can be mounted.

24. Component according to claim 1, further comprising a flow regulator (14) downstream of the jet regulating device (4), wherein the jet regulating device or the flow regulator includes at least one metal filter.

25. Component according to claim 1, wherein the jet regulating device of the component (1) is constructed in a modular manner and multiple mounted elements (5*a*, 5*b*, 5*c*, 5*e*) are attached to one another.

26. Component according to claim 1, wherein the at least one mounted element (5), is at least two mounted elements, which are arranged spaced from one another at a distance.

27. Component according to claim 21, wherein the housing part (8) at the outflow side possesses at least one soft or water-repellent water surface at least in a water discharge opening area.

28. Component according to claim 21, wherein the housing part (8) at the outflow side is manufactured out of an elastic material at least in a water discharge opening area.

29. Component according to claim 21, wherein the housing part (8) at the outflow side is manufactured substantially out of an elastic material or a material with a soft or water-repellent surface.

30. Component according to claim 21, wherein the housing part (8) at the outflow side in a water discharge opening area comprises at least one constriction (23) or equivalent narrowing of its flow-through cross section.

31. Component according to claim 17, wherein a housing part (8) towards an outflow side is connectable to a neighboring housing part (7) towards an inflow side via a snap-on connection.

* * * * *